United States Patent [19]

Chandler

[11] 4,285,130

[45] Aug. 25, 1981

[54] CONTROL DEVICES FOR WEB-FEEDING MACHINES

[75] Inventor: Kenneth Chandler, Bristol, England

[73] Assignee: Masson Scott Thrissel Engineering Limited, Bristol, England

[21] Appl. No.: 117,676

[22] Filed: Feb. 1, 1980

[30] Foreign Application Priority Data

Feb. 10, 1979 [GB] United Kingdom ..... 04793/79

[51] Int. Cl.[3] ..... G01B 5/04

[52] U.S. Cl. ..... 33/132 A

[58] Field of Search ..... 33/132 R, 132 A, 134, 33/136, 133, 129; 200/61.15, 61.16; 242/39, 36

[56] References Cited

U.S. PATENT DOCUMENTS

| | | | |
|---|---|---|---|
| 1,894,307 | 1/1933 | Ek | 33/132 |
| 2,735,055 | 2/1956 | Thomas | 33/132 A X |

*Primary Examiner*—Harry N. Haroian

*Attorney, Agent, or Firm*—Seidel, Gonda, Goldhammer & Panitch

[57] ABSTRACT

This application covers a device included in the microprocessor control for winders or sheeters; the device is arranged to stop the machine when a desired length of web has been fed by accurately-timed start of deceleration from full speed. This avoids the need to run at a lower speed for a period as the desired length is approached.

In the device, the web speed is sensed by a transducer which delivers a speed signal, and from this is calculated the length of web which will be fed during standard deceleration. The result of this calculation can then be compared with the difference between desired length and length already fed (or the result plus length already fed can be compared with desired length) and when the result of this comparison indicates deceleration should start a signal is sent to the braking system.

As an alternative to calculation of length of web fed during deceleration from the sensed speed, the result may be obtained by a "table look-up" operation.

11 Claims, 2 Drawing Figures

CONTROL DEVICES FOR WEB-FEEDING MACHINES

Figure 1:
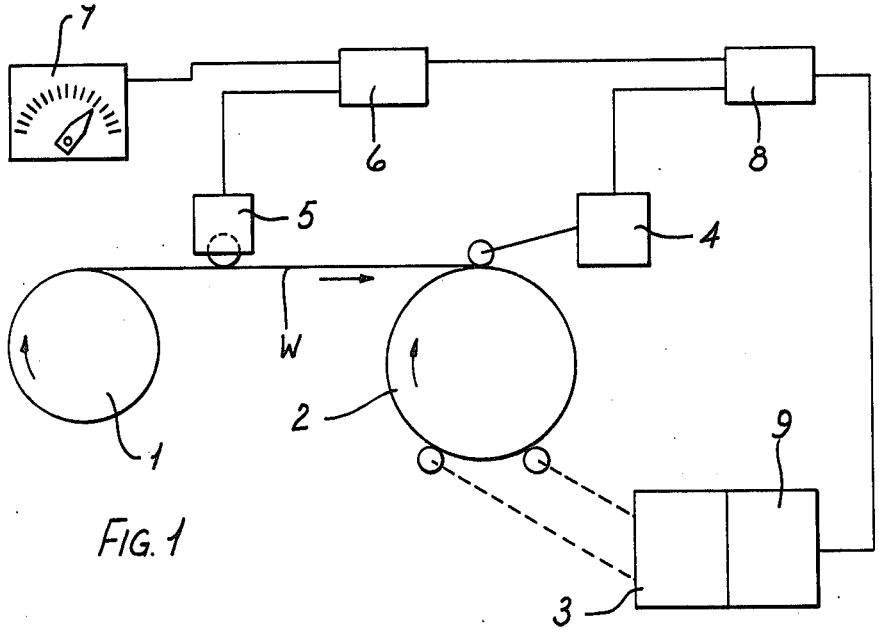

This invention relates to control devices for machines for feeding continuous web material, e.g. paper winders.

A paper winder, for example, is used to produce reels of web of required sizes, both as to width and length. Desired widths are readily obtained by longitudinal slitting of the web during winding, but to obtain a desired length of web in a finished reel presents problems when winding at the high speeds which are commonly employed. In such a machine web is commonly run at speeds of the order of thousands of feet per minute from a supply reel having a mass of several tons, hence winding cannot be stopped abruptly because excessive inertia forces would be produced. It is therefore common practice to obtain a desired length of web in a reel by sensing when a selected length, less than the desired length, has been wound and then to reduce the web speed, continuing winding at such a low speed that when the desired length is attained a substantially immediate stop is possible. This practice, however, causes undesirable reduction in total winder output.

A similar problem is found in a paper sheeter, wherein paper web is fed to a cutter which sub-divides the web by repeated transverse cuts to produce a succession of sheets. In such a machine, it is also necessary to decelerate (although not necessarily to a standstill) when a supply reel is about to become exhausted and a change to a fresh supply reel is to be made.

It is an object of the present invention to provide an improved control device for machines (e.g. paper winders) in which a continuous web is fed, said device enabling deceleration of the web to be initiated at a selected time so that desired deceleration is completed as the feeding of a desired length of web is achieved.

According to the invention, there is provided a control device for a machine for feeding continuous web material (e.g. a paper winder) comprising means for presetting a desired length of web to be fed; means for sensing the web speed during feeding and producing a signal representing said speed; means for producing a length signal representing the length of web already fed; data processing means connected to said presetting means, to said speed sensing means and to said means for producing a length signal; and braking control means operable in response to a brake control signal to produce controlled deceleration of the web; said data processing means being adapted in response to said speed signal to produce a run-out signal representing the length of web fed during said controlled deceleration of the web from the speed represented by the speed signal and then to compare said run-out signal, said length signal, and a signal from the presetting means representing said desired length, and to deliver said brake control signal to the braking control means when said comparison indicates that the desired length of web minus the length already fed is not greater than that represented by the run-out signal.

The data processing means may be arranged to derive the run-out signal either by calculations from the speed represented by the speed signal, or by a "table look-up" operation; in the latter case, the data processing means includes a data-storage device containing a stored table in which, for each of a selected range of web speeds, there is the length of web fed during said controlled deceleration from the respective speed. The data processing means in making said comparison may be arranged to operate in a variety of ways, for example, so as first to subtract the length represented by the calculated run-out signal from the desired length, represented by the signal from the presetting means, and then compare the difference thus obtained with the length already fed, represented by the length signal, emitting the brake control signal if the comparison indicates that the length already fed is not less than the difference. Alternatively, the data processing means may operate so as first to subtract the length already fed from the desired length, then compare the subtraction result with the length represented by the run-out signal, emitting the brake control signal when the comparison shows that the length represented by the run-out signal is not less than that represented by said subtraction result.

With such a control device, there is no need to run the web at a speed lower than the normal running speed of the machine to obtain the desired length of web accurately, as the length fed during controlled deceleration makes up the difference between the length already fed at the start of deceleration and the desired length. If the speed sensing means produces a continuous signal indicating web speed at any instant, then the comparing means will emit the control signal when the length of web already fed is equal to that represented by the difference signal. It is preferred, however, that the device operates with digital signals and an economic form of speed sensing device giving a digital speed signal does not give a continuous output, but delivers a speed signal at regular intervals; the total length fed, using such a speed sensing device, may exceed the desired length by the length of web fed during the interval between successive speed signals and this excess length can therefore be minimised by keeping said intervals short.

The means for indicating length of web already fed may for example be a device including a sensor which is moved as there is an increase of diameter of a reel being formed; in another form, said means may have a wheel or roller in contact with the web so as to be driven thereby, and a pulse generator driven by said wheel or roller and connected to deliver pulses to a digital counter at a rate proportional to the speed of the wheel or roller and hence of the web. The latter form of length indicating device may also be arranged to include the presetting means, by arranging the counter so that it can initially be set to store an indication of the desired length, and so that it responds to the pulses in a negative sense, i.e. on receipt of each pulse the stored length indication is decreased by a corresponding amount. At any time during feeding of web, therefore, the counter's stored indication represents the length of web still required to be fed and a corresponding signal derived from the counter is fed to the data processing means for direct comparison with the calculated run-out signals, the brake control signal being emitted when the comparison indicates that the length represented by the run-out signal is not less than the length represented by the signal from the counter. (The counter thus serves as part of the data processing means, as it performs the subtraction of the length already fed from the desired length).

Figure 2:
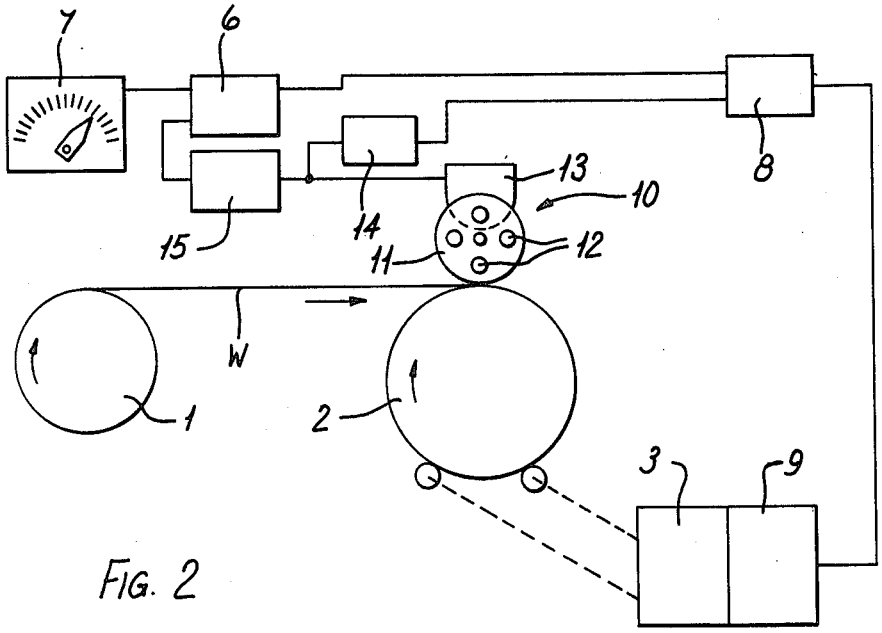

In order that the invention may be well understood, a preferred embodiment thereof will now be described, referring to the accompanying diagrammatic drawings, in which:

FIG. 1 is a block diagram of a control device embodying the invention, for use with a paper winder; and FIG. 2 is a similar diagram of the device, modified in some of its elements.

In FIG. 1, web W is represented as being wound from a supply reel 1 to a take-up reel 2; this showing is of course purely diagrammatic. The take-up reel 2 is linked to a drive unit 3 containing a drive motor and braking means (not shown). The braking means, for use with the present invention, must when operated give controlled deceleration so that, when the winder is braked to a stop from any given running speed, the progress of deceleration is always controlled and hence the length of web taken up on the reel 2 is calculable from the speed at which the web is running immediately before deceleration starts. Such a braking means is the "POWER-STOP" system, obtainable from Printing & Paper Drives Limited, of Kingsbury, which maintains a constant deceleration rate which is present according to the material being wound.

This system operates by using the electric drive motor as a brake; when a stop is to be made, supply current to the motor is switched off, the armature connections of the motor are reversed, and the motor is then energised to give the desired braking effect, this energisation being terminated when the motor stops.

A sensor 4 engaged with the web passing on to the take-up reel 2 produces an output signal constantly indicating the diameter of the reel 2 and thus the total length of web wound on to the reel 2, and a speed sensor 5 engaged with the web W produces at regular intervals a speed signal indicating the linear speed of the web, the sensor 5 being connected to deliver the speed signal to one input of a calculating unit 6. Another input of the unit 6 is connected to receive from a manually-presettable device 7 a signal representing the total length of web it is desired to roll on the reel 2, and the unit 6 operates to calculate from the speed signal the length of web which will be wound on to the reel 2 during controlled deceleration from the web speed represented by the speed signal to a standstill, and produce a run-out signal representing the length of web. The unit 6 then subtracts the results of this calculation from the signal received from the device 7, and delivers a difference signal representing the result of this subtraction to one input of a comparing unit 8, the other input of which receives the output signal from the sensor 4. Alternatively the unit 6 may include a data-storage device containing a stored table on which is represented, for each of a range of web speeds the length of web fed during controlled deceleration from the respective speed.

The difference signal delivered by the calculating unit 6 represents the length of web which is already actually on the reel 2. As soon as the comparing unit senses that the latter signal indicates a length not less than the length indicated by the difference signal from the unit 6, it delivers a control signal to a braking control unit 9 of the drive unit 3; said control signal causes initiation of deceleration so that the reel 2 slows to a stop.

The comparing unit 8 is arranged to deliver the control signal when the comparison indicates that the total length of web already wound is not less than the length represented by the difference signal, rather than when equality is indicated, because the sensor 5 indicates web speed not continuously, but at intervals. Accordingly, even though the intervals are short, an equality indication may not be obtainable from the signals reaching the comparing unit because the equality condition may be reached at a time between the times at which successive speed signals are delivered by the sensor 5.

FIG. 2 shows the device of FIG. 1, modified slightly in that the sensors 4, 5 are replaced by a single sensing device 10, comprising a rotatable wheel 11 engaged with the web W as it winds on to the reel 2, said wheel having a number (shown as four) of regularly-spaced perforations 12 near its periphery, and a sensor 13 (e.g. a photoelectric device or proximity switch) arranged to emit a pulse as each perforation 12 passes it.

The pulses from sensor 13 are delivered to two counting units 14, 15. The unit 14 contains a digital counter which is set to zero when winding of a new reel 2 is started, and counts the pulses from sensor 13 throughout the winding of that reel so that at any instant the number of pulses registered by this counter directly represents the total length of web already wound on to the reel 2 at that instant. The counting unit 15 also contains a counter, but in this instance the counter is under the control of a timing unit which at regular intervals causes the number registered by the counter to be read out and the counter to be reset to zero. Hence the signal produced on readout of the counter in unit 15 directly represents the mean web speed in the time since the last previous resetting of the counter.

The calculating unit 6 may if desired be a device specifically constructed for the purpose of the particular calculation required, as defined above. However, it is preferred to use for this purpose a so-called microprocessor operating a program which includes the particular calculations defined above, and such a microprocessor may also perform the comparison between the difference signal and the signal from sensor 4 (FIG. 1) or counter 14 (FIG. 2) i.e. the microprocessor may serve as both unit 6 and unit 8. This is especially advantageous when as described above the sensor 5, or unit 15, produces a speed signal at intervals as between the times when the speed signal appears the microprocessor may perform other functions.

It will be appreciated that the deceleration rate need not be constant provided that it is controlled according to a law which has been fed into the calculating means.

I claim:

1. A control device for a machine for feeding continuous web material (e.g. a paper winder) comprising means for presetting a desired length of web to be fed; means for sensing the web speed during feeding and producing a signal representing said speed; means for producing a length signal representing the length of web already fed; data processing means connected to said presetting means, to said speed sensing means and to said means for producing a length signal; and braking control means operable in response to a brake control signal to produce controlled deceleration of the web; said data processing means being adapted in response to said speed signal to produce a run-out signal representing the length of web fed during said controlled deceleration of the web from the speed represented by the speed signal and then to compare said run-out signal, said length of signal, and a signal from the presetting means representing said desired length, and to deliver said brake control signal to the braking control means when said comparison indicates that the desired length of web minus the length already fed is not greater than that represented by the run-out signal.

2. A control device as claimed in claim 1 in which said data processing means in making said comparison is arranged to operate so as first to subtract the length represented by the calculated run-out signal from the desired length, represented by the signal from the presetting means, and then compare the difference thus obtained with the length already fed, represented by the length signal, and to emit the brake control signal if the comparison indicates that the length already fed is not less than the difference.

3. A control device as claimed in claim 1 in which said data processing means in making said comparison is arranged to operate so as first to subtract the length already fed from the desired length, then compare the subtraction result with the length represented by the run-out signal, and to emit the brake control signal when the comparison shows that the length represented by the run-out signal is not less than that represented by said subtraction result.

4. A control device as claimed in claim 1 in which the means for indicating length of web already fed is a device including a sensor which is moved as there is an increase of diameter of a reel being formed.

5. A control device as claimed in claim 1 in which said means for indicating length of web already fed is a wheel or roller in contact with the web so as to be driven thereby, and a pulse generator driven by said wheel or roller and connected to deliver pulses to a digital counter at a rate proportional to the speed of the wheel or roller and hence of the web.

6. A control device as claimed in claim 5 in which said wheel is provided with a number of regularly spaced perforations and said pulse generator is a photoelectric sensor arranged to emit a pulse as each perforation passes it.

7. A control device as claimed in claim 5 in which said means for indicating length of web already fed includes the presetting means, and in which the counter is initially set to store an indication of the desired length, and is arranged so that it responds to the pulses such that on receipt of each pulse the stored length indication is decreased by a corresponding amount, where in the counter's stored indication represents the length of web still required to be fed and a corresponding signal derived from the counter is fed to the data processing means for direct comparison with the calculated run-out signals, the brake control signal being emitted when the comparison indicates that the length represented by the run-out signal is not less than the length represented by the signal from the counter.

8. A control device as claimed in claim 1 in which the data processing means is arranged to derive the run-out signal by calculation from the speed represented by the speed signal.

9. A control device as claimed in claim 1 in which the data processing means includes a data-storage device containing a stored table in which, for each of a selected range of web speeds, there is the length of web fed during said controlled deceleration from the respective speed.

10. A control device as claimed in claim 1 in which the speed sensing means produces a continuous signal indicating web speed at any instant, so that the data processing means emits the control signal when the length of web already fed is equal to that represented by the run-out signal.

11. A control device as claimed in claim 1 in which said speed sensing means operates with digital signals and delivers a speed signal at regular intervals; whereby the total length fed, may exceed the desired length by the length of web fed during the interval between successive speed signals.

* * * * *